US006380867B1

(12) United States Patent
Maull

(10) Patent No.: US 6,380,867 B1
(45) Date of Patent: Apr. 30, 2002

(54) TRAFFIC LIGHT SEQUENCE INDICATION SYSTEM

(76) Inventor: Darren O. Maull, 3990 Southcourt St., Montgomery, AL (US) 36105

( * ) Notice: Subject to any disclaimer, the term of this patent is extended or adjusted under 35 U.S.C. 154(b) by 0 days.

(21) Appl. No.: 09/802,565

(22) Filed: Mar. 9, 2001

(51) Int. Cl.[7] ..... G08G 1/096

(52) U.S. Cl. ..... 340/929; 340/309.15; 340/907; 340/691.6

(58) Field of Search ..... 340/929, 309.15, 340/309.4, 309.3, 907, 909, 916, 925, 930, 691.1, 691.3, 691.6, 693.9

(56) References Cited

U.S. PATENT DOCUMENTS

| | | | | | |
|---|---|---|---|---|---|
| 2,683,868 | A | | 7/1954 | McKnight | |
| 3,302,168 | A | | 1/1967 | Gray et al. | |
| 3,320,585 | A | | 5/1967 | Hines | |
| 3,863,251 | A | * | 1/1975 | Gould et al. | 340/382 |
| 4,200,860 | A | | 4/1980 | Fritzinger | |
| D255,337 | S | | 6/1980 | Pummer | |
| 4,590,455 | A | | 5/1986 | Fritzinger | |
| 4,827,258 | A | | 5/1989 | Evans | |
| 4,847,618 | A | | 7/1989 | Baustin | |
| 5,150,116 | A | * | 9/1992 | West | 340/928 |
| 5,519,390 | A | | 5/1996 | Cagini | |
| 5,726,648 | A | | 3/1998 | Soon | |
| 5,838,260 | A | | 11/1998 | Lin | |
| 6,087,962 | A | * | 7/2000 | Rojas | 340/907 |
| 6,175,313 | B1 | * | 1/2001 | Berezovsky | 340/929 |
| 6,268,805 | B1 | * | 7/2001 | Simon | 340/907 |

* cited by examiner

*Primary Examiner*—Daniel J. Wu
*Assistant Examiner*—Phung T Nguyen

(57) ABSTRACT

A traffic light sequence indicating system for indicating time remaining before signal light changes. The traffic light sequence indicating system includes a housing. The housing has a front wall, a back wall, a top wall, and a bottom wall. Control circuitry is mounted in the housing and is operationally coupled to the traffic light controller and adapted to time traffic light sequences. A first display displays information from the control circuitry. A surface of the first display is generally flush with a surface of the front wall. The first display is operationally coupled to the control circuitry. The control circuitry displays indicia indicating minutes and seconds on the first display. A fastening means removably fastens the top wall to the arm of the traffic light system.

7 Claims, 2 Drawing Sheets

FIG. 3
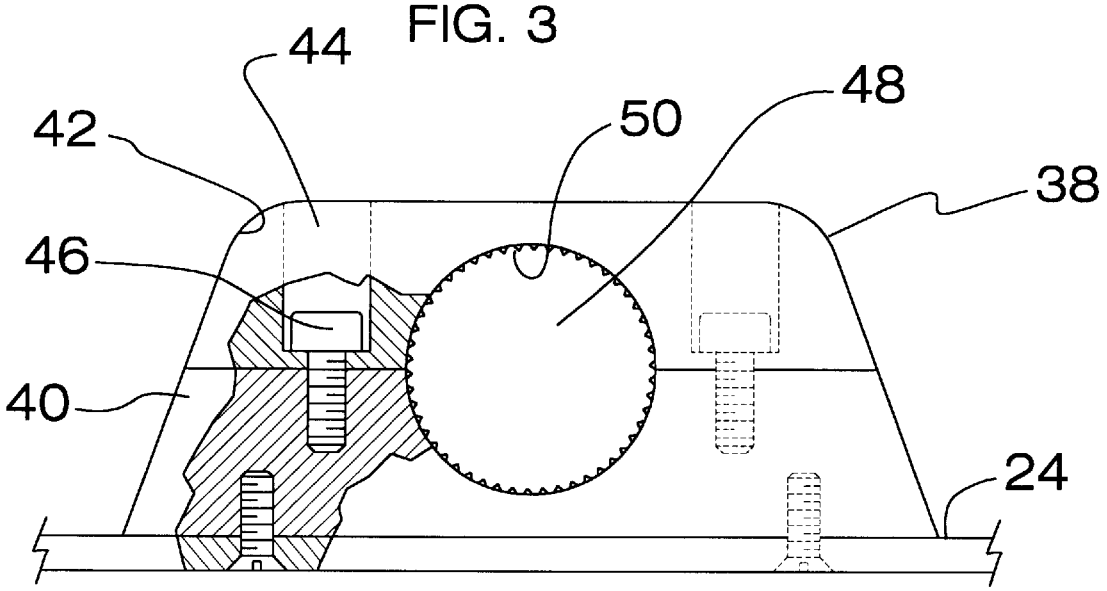
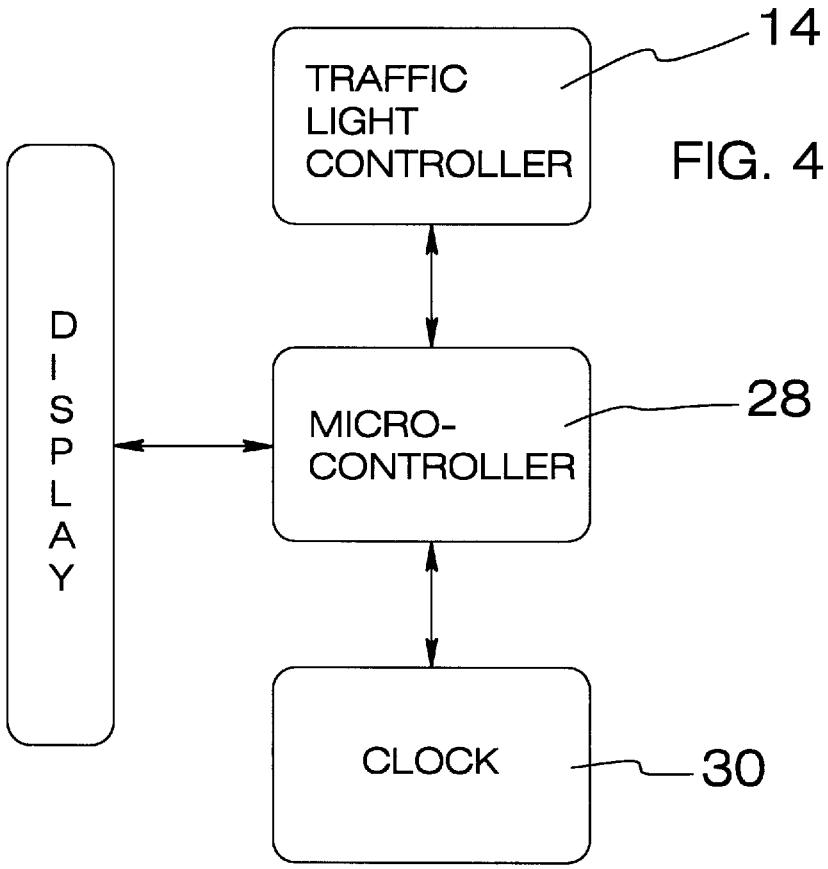
FIG. 4

TRAFFIC LIGHT SEQUENCE INDICATION SYSTEM

BACKGROUND OF THE INVENTION

1. Field of the Invention

The present invention relates to traffic light sequence indicators and more particularly pertains to a new traffic light sequence indicating system for indicating time remaining before signal light changes.

2. Description of the Prior Art

The use of traffic light sequence indicators is known in the prior art. More specifically, traffic light sequence indicators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,827,258; 4,847,618; 2,683,868; 4,200,860; 4,590,455; 3,302,168; 5,726,648; 5,519,390; 3,320,585; U.S. Des. Patent No. 255,337; and U.S. Pat. No. 5,838,260.

While these devices fulfill their respective, particular objectives and requirements, the aforementioned patents do not disclose a new traffic light sequence indicating system. The inventive device includes a housing. The housing has a front wall, a back wall, a top wall, and a bottom wall. Control circuitry is mounted in the housing and is operationally coupled to the traffic light controller and adapted to time traffic light sequences. A first display displays information from the control circuitry. A surface of the first display is generally flush with a surface of the front wall. The first display is operationally coupled to the control circuitry. The control circuitry displays indicia indicating minutes and seconds on the first display. A fastening means removably fastens the top wall to the arm of the traffic light system.

In these respects, the traffic light sequence indicating system according to the present invention substantially departs from the conventional concepts and designs of the prior art, and in so doing provides an apparatus primarily developed for the purpose of indicating time remaining before signal light changes.

SUMMARY OF THE INVENTION

In view of the foregoing disadvantages inherent in the known types of traffic light sequence indicators now present in the prior art, the present invention provides a new traffic light sequence indicating system construction wherein the same can be utilized for indicating time remaining before signal light changes.

The general purpose of the present invention, which will be described subsequently in greater detail, is to provide a new traffic light sequence indicating system apparatus and method which has many of the advantages of the traffic light sequence indicators mentioned heretofore and many novel features that result in a new traffic light sequence indicating system which is not anticipated, rendered obvious, suggested, or even implied by any of the prior art traffic light sequence indicators, either alone or in any combination thereof.

To attain this, the present invention generally comprises a housing. The housing has a front wall, a back wall, a top wall, and a bottom wall. Control circuitry is mounted in the housing and is operationally coupled to the traffic light controller and adapted to time traffic light sequences. A first display displays information from the control circuitry. A surface of the first display is generally flush with a surface of the front wall. The first display is operationally coupled to the control circuitry. The control circuitry displays indicia indicating minutes and seconds on the first display. A fastening means removably fastens the top wall to the arm of the traffic light system.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new traffic light sequence indicating system apparatus and method which has many of the advantages of the traffic light sequence indicators mentioned heretofore and many novel features that result in a new traffic light sequence indicating system which is not anticipated, rendered obvious, suggested, or even implied by any of the prior art traffic light sequence indicators, either alone or in any combination thereof.

It is another object of the present invention to provide a new traffic light sequence indicating system which may be easily and efficiently manufactured and marketed.

It is a further object of the present invention to provide a new traffic light sequence indicating system which is of a durable and reliable construction.

An even further object of the present invention is to provide a new traffic light sequence indicating system which is susceptible of a low cost of manufacture with regard to both materials and labor, and which accordingly is then susceptible of low prices of sale to the consuming public, thereby making such traffic light sequence indicating system economically available to the buying public.

Still yet another object of the present invention is to provide a new traffic light sequence indicating system which provides in the apparatuses and methods of the prior art some of the advantages thereof, while simultaneously overcoming some of the disadvantages normally associated therewith.

Still another object of the present invention is to provide a new traffic light sequence indicating system for indicating time remaining before signal light changes.

Yet another object of the present invention is to provide a new traffic light sequence indicating system which includes a housing. The housing has a front wall, a back wall, a top wall, and a bottom wall. Control circuitry is mounted in the housing and is operationally coupled to the traffic light controller and adapted to time traffic light sequences. A first display displays information from the control circuitry. A surface of the first display is generally flush with a surface of the front wall. The first display is operationally coupled to the control circuitry. The control circuitry displays indicia indicating minutes and seconds on the first display. A fastening means removably fastens the top wall to the arm of the traffic light system.

Still yet another object of the present invention is to provide a new traffic light sequence indicating system that allows motorists to know time remaining for a green light.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic cross-sectional view taken along line 3—3 of the present invention.

FIG. 4 is an electronic schematic view of the present invention.

DESCRIPTION OF THE PREFERRED EMBODIMENT

Figure 1:
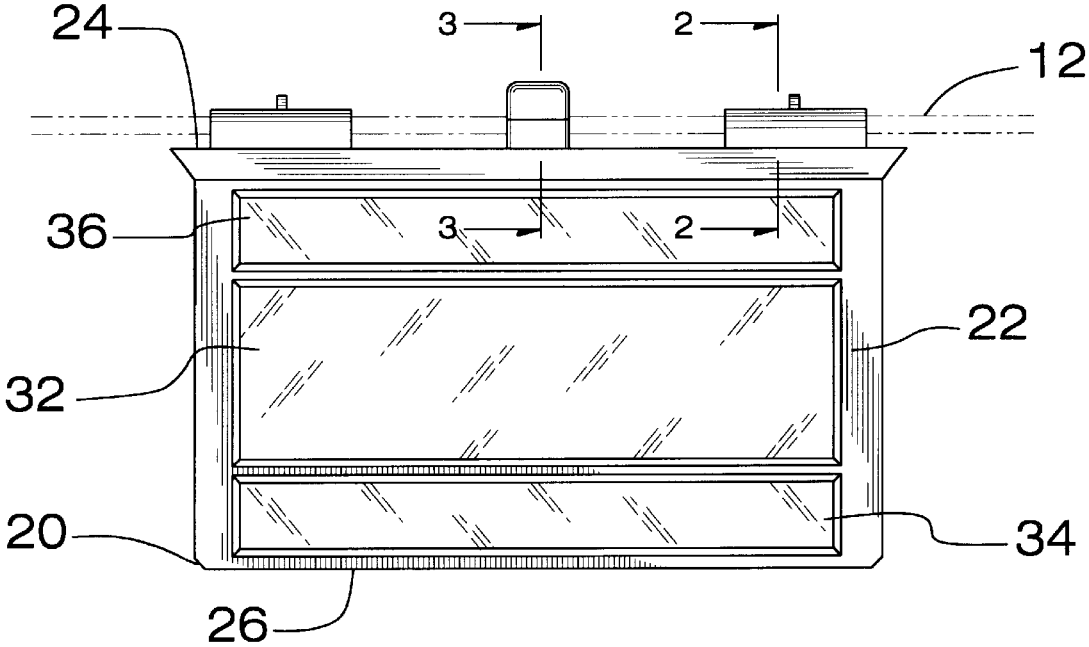
FIG. 1 is a schematic plan view of a new traffic light sequence indicating system according to the present invention.
Figure 2:
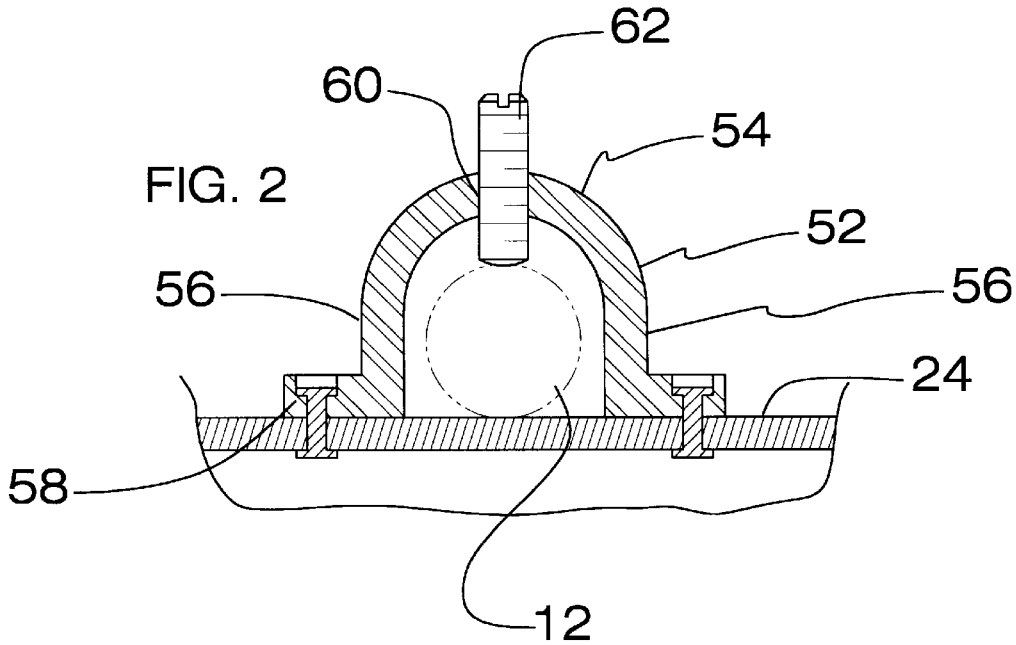
FIG. 2 is a schematic cross-sectional view taken along line 2—2 of the present invention.

With reference now to the drawings, and in particular to FIGS. 1 through 4 thereof, a new traffic light sequence indicating system embodying the principles and concepts of the present invention and generally designated by the reference numeral 10 will be described.

As best illustrated in FIGS. 1 through 4, the traffic light sequence indicating system 10 generally comprises a housing 20 which is mountable to the arm 12 of a conventional traffic light system. The housing 20 has a front wall 22, a back wall, not shown, a top wall 24, and a bottom wall 26.

Control circuitry 28 is mounted in the housing 20. The control circuitry 28 is operationally coupled to the traffic light controller 14. The control circuitry 28 is operationally coupled to a timer 30 and is adapted to track time between a red light changing to a green light and a green light changing to a red light within the traffic light system. The control circuitry 28 is preferably a microprocessor.

A first display 32 displays information from the control circuitry 28. A surface of the first display 32 is generally flush with a surface of the front wall 22. The first display 32 is preferable positioned in a central portion of the front wall 22. The first display 32 is operationally coupled to the control circuitry 28. The first display 32 ideally comprises an illuminated liquid crystal display. The control circuitry 32 displays indicia indicating minutes and seconds on the first display. This display indicates to the motorists the time remaining before the light signal changes color.

A second display 34 displays information from the control circuitry 28. A surface of the second display 34 is generally flush with a surface of the front wall 22. The second display 34 is positioned between the first display 32 and the bottom wall 26. The second display 34 is operationally coupled to the control circuitry 28. The second display 34 ideally comprises an illuminated liquid crystal display. The control circuitry 28 displays indicia indicating red or green on the second display 34. The second display 34 allows motorists to see which light is currently being timed.

A third display 36 displays information from the control circuitry 28. A surface of the third display 36 is generally flush with a surface of the front wall 22. The third display 36 is positioned generally between the first display 32 and the top wall 24. The third display 36 is operationally coupled to the control circuitry 28. The third display 36 comprises an illuminated liquid crystal display. The control circuitry 28 displays indicia indicating a countdown on the third display 36. This allows motorists to know that the first display 32 is indeed a countdown clock and that when the timer runs out of time, the light will change from the one indicated on the second display 34.

A fastening means removably fastens the top wall 24 to the arm 12 of the traffic light system. The fastening means comprises a bracket 38 having a base portion 40 and a top portion 42. The base portion 40 is removably coupled to the top wall 24 of the housing 20. The top portion 42 has bores 44 therein for receiving securing means 46 for removably securing the top portion 42 to the base portion 40. Each of the top 42 and bottom 40 portions has a channel therein. The channels define a bore 48 in the bracket 38 when the top portion 42 is coupled to the bottom portion 40. The arm 12, wire or other support structure of the traffic light system extends through the bore 48. The bore 48 preferably has a roughened surface 50 to aid in gripping the arm 12. Each of the securing means 46 is a screw.

A pair of coupling members 52 couples the housing 12 to the traffic light system. Each of the coupling members 52 has a base portion 54 and two legs 56. Each of the legs 56 has a flange 58 thereon. Each of the coupling members 52 is generally U-shaped. The coupling member 52 is placed over the arm 12 of the traffic light system and the flanges 58 are secured to the top wall 24 by a securing means. The base portions 54 have a bore 60 therein which as a biasing means 62 therein for biasing the base 54 against the arm 12. The biasing means 62 is preferably a screw.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A traffic light sequence timing system, for mounting on the arm of a traffic light system, the traffic light system being operationally coupled to a traffic light controller, said system comprising:

a housing, said housing having a front wall, a back wall, a top wall, and a bottom wall;

control circuitry being mounted in said housing, said control circuitry being operationally coupled to said traffic light controller and adapted to time traffic light sequences;

a first display for displaying information from said control circuitry, said first display having a surface, said first display being operationally coupled to said control circuitry, wherein said control circuitry displays indicia indicating minutes and seconds on said first display;

a fastening means for removably fastening said top wall to the arm of the traffic light system, said fastening means comprising a bracket having a base portion and a top portion, said base portion being coupled to said top wall of said housing, said top portion having bores therein for receiving securing means for removably securing said top portion to said base portion, each of said top and base portions having a channel therein, said channels defining a bore in said bracket when said top portion is coupled to said base portion, said arm of said traffic light system extending through said bore;

a pair of coupling members for coupling said housing to said traffic light system, each of said coupling members having a base portion and two legs, each of said legs having a flange thereon, each of said coupling members being generally U-shaped, wherein said coupling member is positionable over the arm of the traffic light system and said flanges are securable to said top wall by said securing means, each of said base portions having a bore therein; and a biasing means mounted in said bore for biasing said base portion against the arm.

2. The traffic light sequence timing system as in claim 1, wherein said first display is positioned generally in a central portion of said top wall, further comprising a second display for displaying information from said control circuitry, a surface of said second display being generally flush with a surface of said front wall, said second display being positioned generally between said first display and said bottom wall, said second display being operationally coupled to said control circuitry, wherein said control circuitry displays indicia indicating red or green on said second display.

3. The traffic light sequence timing system as in claim 2, further comprising a third display for displaying information from said control circuitry, a surface of said third display being generally flush with a surface of said front wall, said third display being positioned generally between said first display and said top wall, said third display being operationally coupled to said control circuitry, wherein said control circuitry displays indicia indicating a countdown on said third display.

4. A traffic light sequence timing system, for mounting on the arm of a traffic light system, the traffic light system being operationally coupled to a traffic light controller, said system comprising:

a housing having a front wall, a back wall, a top wall, and a bottom wall;

control circuitry being mounted in said housing, said control circuitry being operationally coupled to said traffic light controller, said control circuitry being operationally coupled to a timer, said control circuitry being adapted to track time between a red light changing to a green light and a green light changing to a red light of the traffic light system, said control circuitry being a microprocessor;

a first display for displaying information from said control circuitry, a surface of said first display being generally flush with a surface of said front wall, said first display being positioned generally in a central portion of said front wall, said first display being operationally coupled to said control circuitry, said first display comprises an illuminated liquid crystal display;

a second display for displaying information from said control circuitry, a surface of said second display being generally flush with a surface of said front wall, said second display being positioned generally between said first display and said bottom wall, said second display being operationally coupled to said control circuitry, said second display comprises an illuminated liquid crystal display;

a third display for displaying information from said control circuitry, a surface of said third display being generally flush with a surface of said front wall, said third display being positioned generally between said first display and said top wall, said third display being operationally coupled to said control circuitry, said third display comprises an illuminated liquid crystal display;

wherein said control circuitry displays indicia indicating minutes and seconds on said first display;

wherein said control circuitry displays indicia indicating red or green on said second display;

wherein said control circuitry displays indicia indicating a countdown on said third display;

a fastening means for removably fastening said top wall to the arm of the traffic light system, said fastening means comprising a bracket having a base portion and a top portion, said base portion being removably coupled to said top wall of said housing, said top portion having bores therein for receiving securing means for removably securing said top portion to said base portion, each of said top and base portions having a channel therein, said channels defining a bore in said bracket when said top portion is coupled to said base portion, said arm of said traffic light system extending through said bore, each of said securing means being a screw; and a pair of coupling members for coupling said housing to said traffic light system, each of said coupling members having a base portion and two legs, each of said legs having a flange thereon, each of said coupling members being generally U-shaped, wherein said coupling member is placed over the arm of the traffic light system and said flanges are secured to said top wall by said securing means, each of said base portions having a bore therein having a biasing means therein for biasing said base against the arm, said biasing means being a screw.

5. A traffic light sequence timing system, for mounting on the arm of a traffic light system, the traffic light system being operationally coupled to a traffic light controller, said system comprising:

a housing, said housing having a front wall, a back wall, a top wall, and a bottom wall;

control circuitry being mounted in said housing, said control circuitry being operationally coupled to said traffic light controller, said control circuitry being operationally coupled to a timer, said control circuitry being adapted to track time between a red light changing to a green light and a green light changing to a red light of the traffic light system;

a first display for displaying information from said control circuitry, said first display being operationally coupled to said control circuitry;

a second display for displaying information from said control circuitry, a surface of said second display being generally flush with a surface of said front wall, said second display being operationally coupled to said control circuitry;

a third display for displaying information from said control circuitry, a surface of said third display being generally flush with a surface of said front wall, said third display being operationally coupled to said control circuitry;

wherein said control circuitry displays indicia indicating minutes and seconds on said first display;

wherein said control circuitry displays indicia indicating red or green on said second display;

wherein said control circuitry displays indicia indicating a countdown on said third display;

a fastening means for removably fastening said top wall to the arm of the traffic light system, said fastening means comprising a bracket having a base portion and a top portion, said base portion being removably coupled to said top wall of said housing, said top portion being removably attachable to said base portion, each of said top and base portions having a channel therein, said channels defining a bore in said bracket when said top portion is coupled to said base portion, said arm of said traffic light system extending through said bore; and a pair of coupling members for coupling said housing to said traffic light system, each of said coupling members having a base portion and two legs, each of said legs having a flange thereon, each of said coupling members being generally U-shaped, wherein said coupling member is placed over the arm of the traffic light system and said flanges are secured to said top wall by said securing means, each of said base portions having a bore therein having a biasing means therein for biasing said base against the arm.

6. The traffic light sequence timing system as in claim 5, wherein said first display is positioned generally in a central portion of said front wall, said second display being positioned generally between said first display and said bottom wall, said third display being positioned generally between said first display and said top wall.

7. The traffic light sequence timing system as in claim 6, wherein each of said first, second and third displays comprises an illuminated liquid crystal display.

* * * * *